US009415904B1

(12) United States Patent
Spooner

(10) Patent No.: US 9,415,904 B1
(45) Date of Patent: Aug. 16, 2016

(54) EXTRACTION FACILITATING CORK CLOSURE

(76) Inventor: James E. Spooner, Albuquerque, NM (US)

( * ) Notice: Subject to any disclaimer, the term of this patent is extended or adjusted under 35 U.S.C. 154(b) by 1233 days.

(21) Appl. No.: 12/437,661

(22) Filed: May 8, 2009

Related U.S. Application Data

(63) Continuation-in-part of application No. 10/436,570, filed on May 13, 2003, now Pat. No. 7,533,781.

(51) Int. Cl.
*B65D 39/00* (2006.01)
*B65D 39/16* (2006.01)

(52) U.S. Cl.
CPC ..... *B65D 39/16* (2013.01)

(58) Field of Classification Search
USPC ..... 215/296, 297, 298, 299, 300, 364, 355
See application file for complete search history.

(56) References Cited

U.S. PATENT DOCUMENTS

| | | | | |
|---|---|---|---|---|
| 1,162,017 | A | 11/1915 | Barrett | |
| 1,296,444 | A | 3/1919 | Webb | |
| 2,046,224 | A | 6/1936 | Vanderhoof | |
| 3,006,494 | A | 10/1961 | Reibeling | |
| 3,307,727 | A | 3/1967 | Garay | |
| 3,330,282 | A | 7/1967 | Visser et al. | |
| 3,419,172 | A | 12/1968 | Lee | |
| 3,559,834 | A | 2/1971 | Taylor | |
| 3,970,207 | A | 7/1976 | Faulstich | |
| 4,182,458 | A | 1/1980 | Meckler | |
| 4,364,486 | A * | 12/1982 | Korte et al. | 215/296 |
| 4,446,673 | A | 5/1984 | Desthieux | |
| 4,893,636 | A | 1/1990 | Cook et al. | |
| 5,060,812 | A | 10/1991 | Ogle, II | |
| 5,297,561 | A | 3/1994 | Hulon | |
| 5,636,757 | A | 6/1997 | Porvaznik | |
| 5,722,548 | A | 3/1998 | Hojnoski | |
| 5,868,264 | A | 2/1999 | Fulford et al. | |
| 5,884,789 | A * | 3/1999 | Gardner | 215/299 |
| 5,893,476 | A | 4/1999 | Esteron | |
| D414,694 | S | 10/1999 | Richter | |
| 6,029,836 | A | 2/2000 | Ligeras | |
| 6,036,541 | A | 3/2000 | Koumatsu | |
| 6,168,036 | B1 | 1/2001 | Teng | |
| 6,241,112 | B1 | 6/2001 | Claessens et al. | |
| 6,316,511 | B1 * | 11/2001 | Davies et al. | 521/143 |
| D462,625 | S | 9/2002 | Martin | |
| 6,568,549 | B1 | 5/2003 | Miller | |
| 6,601,722 | B1 | 8/2003 | Litoux-Desrue et al. | |
| 6,796,449 | B2 | 9/2004 | Fragola | |
| 7,533,781 | B1 | 5/2009 | Spooner | |
| 2004/0231465 | A1 * | 11/2004 | Yu | 81/3.29 |

FOREIGN PATENT DOCUMENTS

EP 629559 A1 * 12/1994

OTHER PUBLICATIONS

"Brief for Appellee", Appeal No. 90-1372 In RE James E. Spooner.

* cited by examiner

*Primary Examiner* — J. Gregory Pickett
*Assistant Examiner* — Niki M Eloshway

(57) ABSTRACT

An improved cork closure for beverage and wine bottles having a recess on the outer face of the closure. The recess is designed to facilitate the extraction process by providing central constraint on the position of the corkscrew on the face of the closure and to guide the corkscrew along the axis of the closure. This recess does not interfere with any other type of extraction device.

9 Claims, 4 Drawing Sheets

40

EXTRACTION FACILITATING CORK CLOSURE

CROSS REFERENCE TO RELATED APPLICATIONS

This application is a continuation-in-part application of U.S. patent application Ser. No. 10/436,570, entitled "Extraction Facilitating Cork Closure", to James E. Spooner, filed on May 13, 2003, and the specification and claims thereof are incorporated herein by reference.

BACKGROUND OF THE INVENTION

1. Field of the Invention (Technical Field)

Embodiments of the present invention relate to closures for bottle openings and more specifically to extractable closures for wine bottle openings.

2. Description of Related Art

Cylindrical cork closures are commonly used in wine bottles. Cut from natural cork, the closure is an elastic liquid-proof material that has a diameter that is slightly larger than the inner diameter of the neck of the bottle so that when it is compressed and inserted into the neck of the bottle it seals the bottle and forms a leak-proof closure. The closure is usually placed so that its outer face is essentially flush with the opening lip of the bottle. The closure may include a wrapper or capsule that covers the outer face of the closure and surrounds the neck to protect against contamination. With the advent of the cork, however, and especially where the cork was installed flush with the lip of the bottle, the need for extraction became the necessity for which the corkscrew was invented.

The traditional corkscrew in its simplest form is an open metal helix or solid shank screw with an attached handle for manipulation. The corkscrew requires some skill in use with the objective being to withdraw the cork from the bottle whole and intact. An unsuccessful withdrawal can result in a broken cork that has to be dug out or pushed into the bottle. Either result is undesirable and is displeasing to the user. Other configurations of cork extractors have been developed over the years as described by Bernard Watney and Homer Babbidge in *Corkscrews for Collectors* (Philip Wilson Publications, London, England, 1981), but the helix or solid shank corkscrews still are the predominant tools.

Watney and Babbidge also describe the correct procedure and objectives for achieving a successful withdrawal. It requires (a) centering the axis of the corkscrew on the face of the exposed closure and (b) with a twisting motion advance it along the axis of the closure until sufficient material is engaged to permit withdrawing the closure without cracking or breaking the cork material. Deviation from these actions can result in the corkscrew advancing to the side of the closure where it becomes cramped against the neck of the bottle and may require additional force to withdraw or even bending of the corkscrew. At the very least this impairs the extraction by limiting further penetration and produces anxiety. Worse it may cause tearing or fracture of the cork requiring additional work to open the bottle and destroying the pleasure of the moment. And at worst, the glass of the bottle may be broken, making the wine unusable.

In the hands of a skilled user, these failures seldom occur, but even so do occur as described in the article "Corkscrews that Work" by Paul Fredericksen (Wine Review, May 1946). In the hands of a novice or occasional user, the rate will certainly rise, if not to a large number in absolute terms, then at least sufficient to cause some reluctance by the consumer in choosing a corked bottle. As evidence that the simple task of extracting a cork does challenge the user, observe the historical variety as described in *Corkscrews for Collectors*, and "Symptoms of Withdrawal" (H. Kraus and H. Babbidge, The Chartered Mechanical Engineer, Britain, December 1977) as well as numerous U.S. Patents and the large selection of devices on the market that address the problem of central positioning and guidance for the corkscrew extractor itself. Most achieve this result by providing a rigid housing that rides on the exposed lip of the bottle while holding the helix of the corkscrew in a central location with respect to the closure (Paul Fredericksen, Wine Review, May 1946). Yet the simple direct-pull and lever-pull corkscrews that rely upon the user's skill to centrally locate and axially guide the screw are still sold in abundance.

For fine wines that improve with age, the bottle will be laid down with the wine in contact with the inner face of the closure to promote aging of the wine. The use of a cork is considered by many connoisseurs to be necessary for this purpose. Although aging is a very complex chemical process, one contributing mechanism is a very slow reaction in the wine over time, often years, as a result of permeation of a minuscule amount of oxygen through the cork material. Therefore, it is important that a bottle closure for wine bottles does not impede this process.

There are asymmetrically configured closures, such as for champagne and fortified wines, that require additional equipment on the bottling line. When such bottle closures are provided by their manufacturer to a winery, the winery must add collating or detecting equipment in the bottling line for establishing proper orientation prior to insertion in the bottle.

Recently, plastic materials have been developed that simulate natural cork and are being used for less expensive wine. For these simulated cork closures, objective (a) and (b) as described above are still active and this modification can be applied to them with the same benefits as described for natural cork.

Traditionally, the neck and mouth of the bottle are enclosed with a capsule that protects the outer face of the closure against contamination, but does not obstruct permeation of air. While this tradition is still in use, in recent years the capsule has been eliminated by some wineries in favor of a compressible plastic or wax plug placed and retained in the neck of the bottle covering the outer face of the closure. Because this plug not only protects the face of the closure, but also seals it against permeation, it is considered to be appropriate only for common wines that will not significantly benefit from extensive aging.

For the foregoing reasons, there is a need for a bottle closure that is able to guide the entering position and the advancing direction of the corkscrew in an extraction operation; there is a need for making a bottle closure that will not impede the permeation of air; and there is also a need that the bottle closure contains guiding mechanisms in both ends of the closure for the convenience of production.

SUMMARY OF THE INVENTION

It is accordingly the object of this invention to make improvements to closures for wine and other beverage bottles requiring auxiliary extraction devices such as a conventional open helix or solid shank screw type corkscrew to effect opening of the bottle. In one aspect of the invention, a guiding means is provided on the outer face of the closure and provides positioning constraint to the tip of a conventional corkscrew during manual manipulation and guides the advancing direction of the corkscrew during the extraction process. The essential nature of the guiding means is that it is a structure that modifies the otherwise flat outer face of the closure. That structure provides constraint for the tip of the corkscrew and is located to promote central guidance for the corkscrew as it enters the closure. The structure may be a recess or a protrusion with respect to the flat outer face. Both of these structures provide surfaces that offer one or more constraining walls to the tip of a corkscrew. Multiple guiding means can be provided on the outer face to accommodate varying sizes of commercially available corkscrews.

The structure can take many forms. It may be an annular recess, a nipple-like projection, a plurality of cylindrical recesses assembled according to their sizes, multiple co-central annular rings or grooves, multiple separated holes, and multiple annular recesses positioned in an asymmetrical pattern, as fully explained below. The guiding means may also include single or multiple linear recesses or channels that are disposed symmetrically or asymmetrically about the center of the outer closure face. The cross-section of the recess may be rectangular, "u" or "v" shaped or any other shape that provides a wall for constraining the tip of the corkscrew.

All of these guidance structures permit constraint of the tip of the corkscrew as it initially enters the closure. The position of that constraint is such that the axis of the corkscrew can be positively located near the axis of the closure by a user thus promoting central guidance of the corkscrew as it enters and advances into the closure. The body of the corkscrew will then be located away from the inner face of the bottle opening thus encouraging the development of maximum grip during extraction and discouraging contact of the corkscrew with the bottle neck. These conditions will encourage a successful extraction. For an open helical corkscrew, this means that the tip of the corkscrew is constrained between the outer surface of the closure and the center of the closure face. For a solid shank or screw type corkscrew the guiding tip will be ideally located at the center of the outer face of the closure.

In another aspect of the present invention, the improved bottle closure may have guiding means in each of its outer and inner faces of the cylindrical body, making it more cost-effective for the wine manufacturers to use pre-fabricated bottle closures.

The guiding means used in the improved bottle closure does not interfere with any other type of extraction devices, including those with metal positioning devices.

One embodiment of the present invention and in combination with a wine bottle, the bottle having an opening and an extractable closure for the opening, the closure comprises a cylindrical body having an outer face and an inner face. The cylindrical body comprises a length of the closure from the outer face to the inner face and comprises a compressible material and disposed in the bottle opening. In this embodiment a corkscrew guide is disposed in the outer face of the closure. The corkscrew guide comprises an annular recess. The recess accepts a tip of a corkscrew and has at least one wall to constrain the tip of the corkscrew. In this embodiment, the recess is adapted to a helix of the corkscrew to promote a central position of the corkscrew during use of the corkscrew.

Another embodiment of the present invention and in combination with a wine bottle, said bottle having an opening and an extractable closure for the opening, the closure comprises a cylindrical body having an outer face and an inner face. In this embodiment, the cylindrical body comprises a length of the closure from the outer face to the inner face and comprises a compressible material and is disposed in the bottle opening. A corkscrew guide is disposed in the outer face of the closure. The corkscrew guide comprises an approximately cylindrical bore to accept and constrain the corkscrew helix. The bore does not penetrate through the entire longitudinal axis of the closure and the bore has a sufficient depth to provide lateral support and longitudinal guidance to the corkscrew during use. In this embodiment, the bore is adapted to a helix of the corkscrew to promote a central position of the corkscrew during use of the corkscrew.

A further embodiment of the present invention and in combination with a wine bottle, the bottle having an opening and an extractable closure for the opening, the closure comprises a cylindrical body having an outer face and an inner face. In this embodiment, the cylindrical body comprises a length of the closure from the outer face to the inner face and comprises a compressible material and is disposed in the bottle opening. A corkscrew guide is disposed in the outer face of the closure. The corkscrew guide comprises one or more recesses. The one or more recesses accepts a tip of a corkscrew and has at least one wall to constrain the tip of the corkscrew and promotes positioning of the corkscrew as the corkscrew penetrates the closure. The one or more recesses are adapted to a helix of the corkscrew to promote a central position of the corkscrew during use of the corkscrew.

In a preferred embodiment of the present invention, one or more recesses are selected from the group consisting of a plurality of recesses of different diameters assembled according to their sizes, a plurality of co-central annular rings assembled according to their sizes, a plurality of v-shaped grooves assembled according to their sizes, multiple separated holes, and a combination thereof.

In an embodiment of the present invention, one or more recesses comprise a plurality of co-central annular rings of different diameters assembled according to their diameters.

In another embodiment of the present invention, one or more recesses comprise an outer opening, the opening is preferably smaller than an inner diameter of the bottle opening.

In yet another embodiment of the present invention, one or more recesses are substantially centered on an axis of the outer face.

In a further embodiment of the present invention one or more recesses are positioned asymmetrically on the outer face.

In one embodiment of the present invention, one or more recesses comprise multiple separated holes disposed on the outer face. Alternatively, one or more recesses comprise multiple intersecting annular recesses that are not centered on the outer face.

In another embodiment of the present invention, one or more recesses comprise a plurality of co-central cylindrical recesses of various diameters disposed in the outer face according to diameter, a largest of the recesses is disposed closest to the outer face in relation to other recesses and a smallest of the recesses is disposed farthest from the outer face.

In a further embodiment of the present invention, the one or more recesses are linear.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims

BRIEF DESCRIPTION OF DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The bottle closure of the present invention is an improved cylindrical cork closure, which is inserted into and approximately flush with the opening of the bottle. A modification is made to include in-place guiding means that assist the user in achieving two objectives for successful extraction of the closure: (a) constraining the tip of the helix so the axis of the corkscrew is at or near the center of the exposed face of the closure and (b) guiding the corkscrew to advance along the axis of the closure. Both of these actions will promote successful extraction of the closure from the bottle by the user, especially with simple corkscrew devices lacking mechanical means for assuring the desired central guidance. When the outer face of the closure is obstructed by a non-integral protective plug device, these guidance functions can be accomplished by incorporating the in-place guiding means onto the outer face of the plug device.

In its simplest form, objective (a) is achieved by providing a central depression or recess on the outer face of the in-place closure. This recess is shaped to centrally position the axis of the corkscrew when the tip of helix is placed against the side of the recess. Additionally, the recess may be deepened or narrowed to provide lateral restraint on the advancing direction of the corkscrew as it advances into the cork, thus promoting objective (b).

Figure 1:
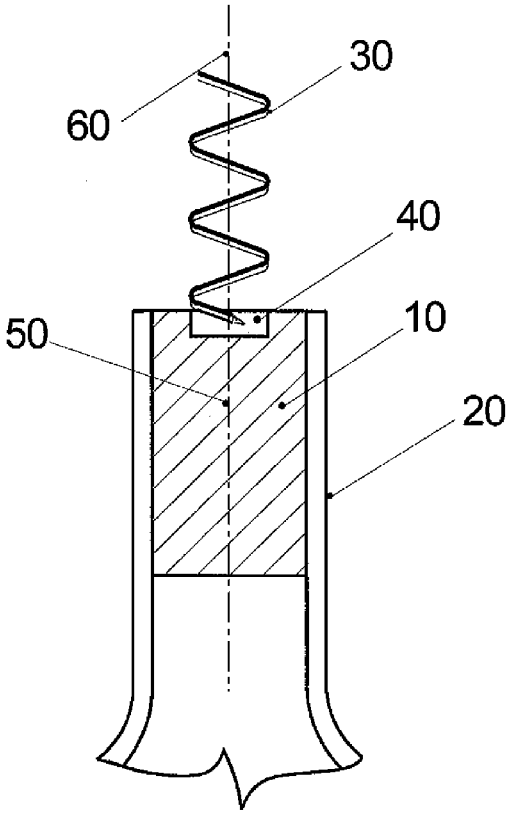
FIG. 1 is an axial section at the top portion of a corked bottle showing the bottle, a cylindrical body with a shallow cylindrical recess on one face of the body, and the relationship to the corkscrew in use.

Referring to FIG. 1, cork closure 10 is shown in the neck of bottle 20 as in use. A centrally located shallow guiding means 40 (a cylindrical recess in this example) physically constrains the radial location of the tip of the entering corkscrew 30. Guiding means 40 also provides a constraint to axis 60 of the corkscrew so that it is substantially coincident with the axis of closure 50 when the corkscrew advances during extraction process. The depth need only be sufficient to engage the tip of the corkscrew or as little as approximately 0.1 inches. Guiding means 40 preferably has a diameter of approximately 0.1 to 0.8 inches and more preferably has a diameter of approximately 0.3 to 0.4 inches to accommodate corkscrews in use or commercially available. Although the diameter of the guiding means and the diameter of the corkscrew may not match, departure of the axis of the corkscrew from the center of the closure is controlled and minimized.

Figure 2:
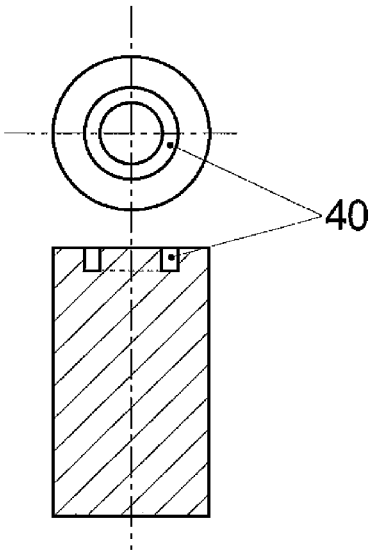
FIG. 2 shows a section through the longitudinal axis of the closure with an annular shallow recess.

One of the embodiments of the present invention is shown in FIG. 2, where guiding means 40 comprises a shallow annulus or ring in the exposed face of the cylindrical body. This geometry provides central guidance more effectively than an open cylinder recess since the tip of the helix is constrained in two radial directions rather than one. The outer diameter preferably has a maximum diameter that is expected for a helical corkscrew, or approximately 0.4 to 0.5 inches, and the inner diameter preferably matches the smallest diameter to be encountered or about 0.2 to 0.3 inches. Thus, the width of the ring is preferably approximately 0.1 to 0.3 inches and more preferably approximately 0.15 to 0.25 inches. However, the width of the ring can even be smaller, perhaps no more than 0.05 inches or just enough to engage the tip of the corkscrew. This produces some central offset between the axis of the corkscrew and cork, but the offset is preferably less than 0.1 inches. Even a simple annular slit is effective in grabbing and guiding the tip of the corkscrew. Because narrower widths constrain angular movement with respect to the axis of the closure, these narrower widths lend lateral support for longitudinal guidance.

Figure 3:
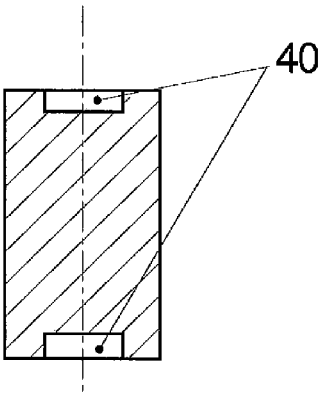
FIG. 3 is an axial section of the closure showing a recess on both faces of the cylindrical body.

In another embodiment of the present invention, guiding means 40 is located in both faces of the cylindrical body as illustrated in FIG. 3. The advantage presented by having guiding means 40 on both faces of the cylindrical body is that no modification of the bottling line is required. The closure manufacturer can provide the closure in this configuration and the winery can insert it with existing equipment without modification to the bottling line. Guiding means 40 is also preferably presented on the exposed face while guiding means 40 on the inner face has no adverse effect on contained wine or beverage. This option is probably the least expensive of all alternatives for modified closures with an integral recess. While the closure has the approximate same height disposed within the bottleneck for effective sealing, it also has a reduced distance between the inner and outer faces of the cylindrical body, promoting permeation and resulting in accelerated aging of the contained wine.

Figure 4:
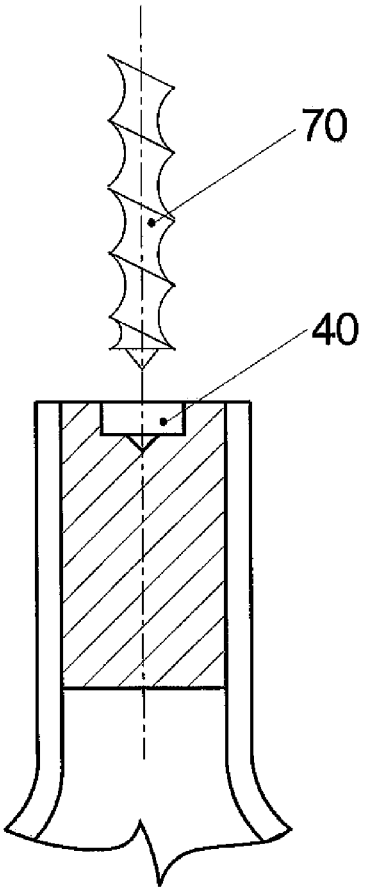
FIG. 4 is an axial section showing a v-shaped recess at the center of the floor of a shallow recess and the relationship to a screw-type corkscrew in use.

In another embodiment of the present invention and as illustrated in FIG. 4, guiding means 40 comprises multiple recesses that are adapted for both a helical and a screw-type corkscrew. A shallow cylindrical recess provides guidance for the helical structure while the additional centrally located v-shaped recess constrains the tip of the screw-type closure. The cylindrical recess can be elongated to a greater depth, but is preferably short of the inner face, so that lateral constraint is introduced to promote guidance along the axis of the closure. The wall of guiding means 40 can also be tapered slightly to provide a conic surface with a larger opening near the outer face of the closure thereby accommodating different sizes of corkscrew.

Figure 5:
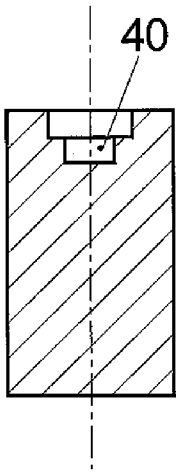
FIG. 5 is an axial section showing a smaller shallow cylindrical recess at the center of the floor of a shallow cylindrical recess.

In another embodiment of the present invention and as illustrated in FIG. 5, guiding means 40 comprises a recess formed by multiple cylindrical recesses of different sizes. Since corkscrews are found in many sizes, each of the individual recesses is adapted to providing central guidance for a helical corkscrew of comparable size. The smallest recess is closest to the inner face of the closure while the largest recess is closest to the outer face of the closure.

Figure 6:
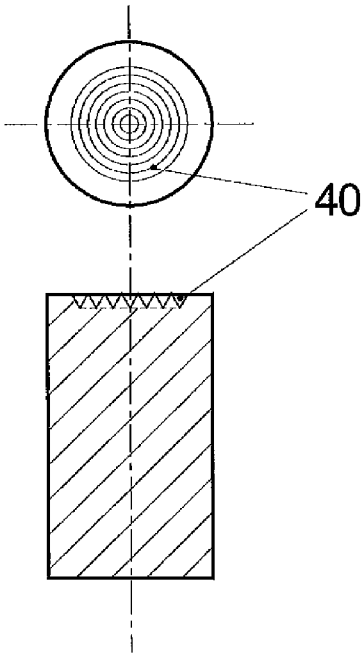
FIG. 6 is an axial section of the closure showing multiple v-shaped annular recesses on the outer face of the cylindrical body.
Figure 7:
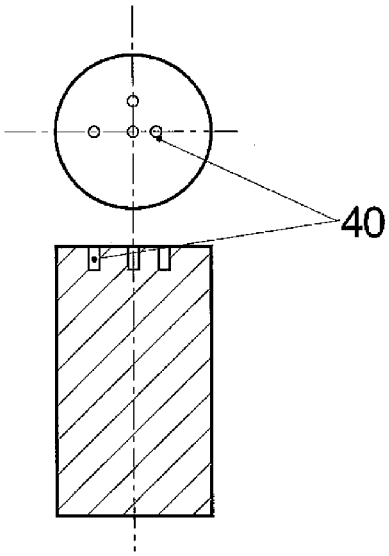
FIG. 7 is an axial section of the closure showing multiple separated holes located to engage the tip of the corkscrew at varying distances from the center of the closure.
Figure 8:
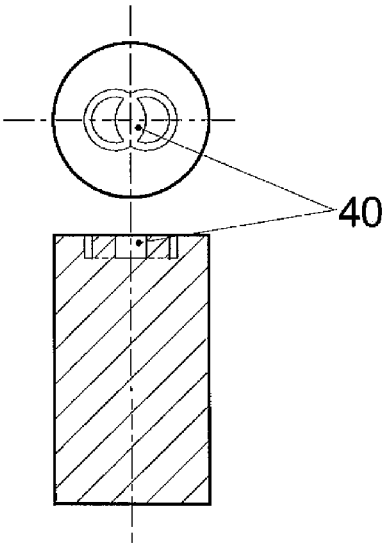
FIG. 8 is an axial section of the closure showing multiple annular recesses positioned in an asymmetrical pattern with the center of the cylindrical body.

There are many other variations of guiding means. FIG. 6 illustrates another embodiment of the improved bottle closure, where guiding means 40 comprises a plurality of circular v-shaped or similar grooves. This improved bottle closure can be used with helical corkscrews of varying sizes and provides central constraint for the screw-type corkscrew. FIG. 7 shows guiding means 40, in the form of multiple small holes, located at an increasing distance from the center of the cylindrical body. These holes are large enough to engage the tip of the corkscrew and provide positioning for varying sizes of helical corkscrews as well as central positioning for the screw-type. FIG. 8 is an illustration of the diversity that guiding means 40 can take. It shows intersecting annular recesses that provide positioning for both the helical and the screw-type corkscrews. Guiding means 40 illustrated in FIG. 8 can be used with the embodiment shown in FIG. 3.

A recess can be readily drilled or burned into the exposed face of an in-place unmodified cork closure as the bottle moves down the bottling line. This requires drilling and dust elimination machinery to be added after corking. Alternatively, if the recess is created on one face only in the manufacturing process and supplied to the winery with the recess preformed, then the closure must be collated or machinery that detects the recess and positions of the closure prior to insertion in the bottle must be added to the bottling line.

Figure 9:
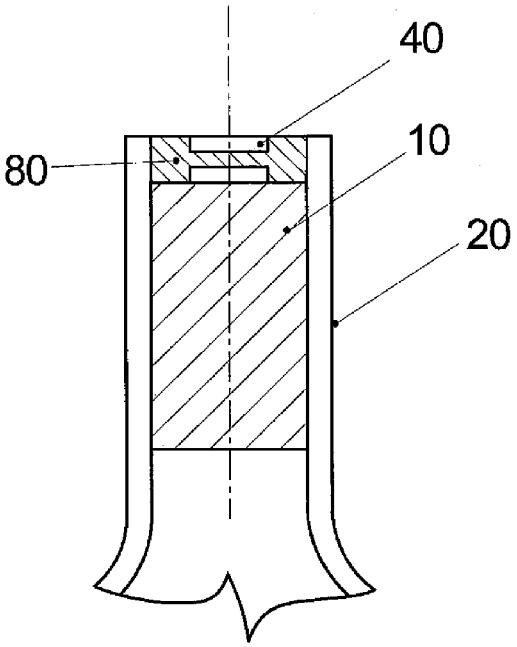
FIG. 9 is an axial section at the top portion of a corked bottle showing the bottle, a cylindrical body, and a plug with a shallow recess.

In a case where a disk-like plug is used, to substitute for the capsule assembled above the cylindrical body, the plug modification shown in FIG. 9 provides central guidance for the corkscrew tip. This figure shows cork cylindrical body 10 in the neck of bottle 20 as it occurs in use. Centrally located shallow annular recess 40 in plug 80 physically limits the radial location of the tip of the entering corkscrew. This configuration also guides the user in centrally locating the axis of the corkscrew coincident with the axis of the cylindrical body or the plug and helps the user keep the corkscrew in the axis of the cylindrical body during extraction process. Any of the guiding means previously disclosed for all embodiments shown from FIGS. 1 to 8 can be used with the plug. It is necessary only to limit the depth of the recess to a dimension less than the depth of the plug to assure that the face of the closure is protected.

If the disk-like plug is formed with plastic, it may be supplied by the manufacturer with a preformed recess in which case it would be beneficial to have it collated so that the recess need not be detected prior to insertion on the bottling line. Or, as with the bottle closure without a plug, the guiding means may be formed on both faces of the plug eliminating the need for collation. Only the guiding means in the outer face performs the intended guiding functions while the guiding means in the inner face does not have any negative effect on the performance of the battle closure. For those wineries already using this type of plug, either of these solutions appears to be preferable to drilling the recess on the bottling line since the plugging machines are in place and need not be modified.

As a way to emphasize the utility of the recess, the plug may be fabricated of two layers of differing colors or comprise of two component disks of same or different colors. The recess can then penetrate through one layer to expose the next so that the recess is visually located for the user.

If the plug is made of wax and it is formed in the bottling line by pouring molten wax into the bottleneck, an additional piece of machinery must be added to form the recess or the guiding means either by melting the wax or cutting.

The guiding means is incorporated in the outer face of the plug, but it is limited in depth to less than the plug thickness so the plug material remains intact over the face. The recess can be drilled, burned, or if formed with wax, melted into the plug with a hot template.

Figure 10:
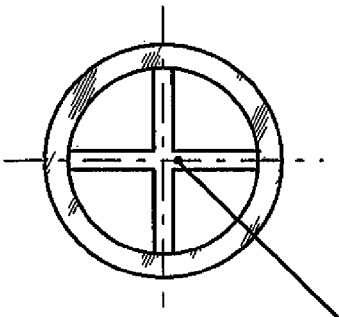
FIG. 10 is a plan view of an outer face of a bottle closure showing multiple linear recesses traversing the face and intersecting the center of the closure.
Figure 11:
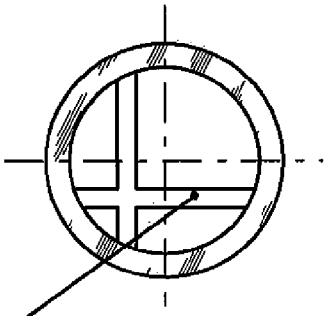
FIG. 11 is a plan view of an outer face of a bottle closure showing multiple linear recesses traversing the face and asymmetrical to the center of the closure.
Figure 12:
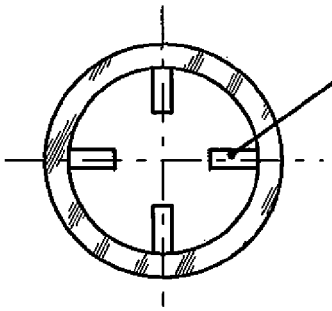
FIG. 12 is a plan view of an outer face of a bottle closure showing multiple linear recess segments positioned to provide guidance.

FIGS. 10 through 12 show alternate linear recesses 40 that provide constraint and produce central guidance. It is possible that other shapes, such as square or hexagonal, can be used for the recess and still provide guidance and constraint for the tip of the corkscrew and preferably gives more lateral support than a cylindrical shape. However, the circular or linear shape of the recess is the simplest and the easiest to form with readily available tools.

A significant and critical property of this invention is that there is no interference, modification, or prevention of use for any known cork extraction method or device and permeation is not impaired where that is a concern.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. In combination with a wine bottle, said bottle having an opening and an extractable closure for said opening, said closure comprising:

a solid cylindrical body having an outer face and an inner face, said cylindrical body comprising a length of said closure from said outer face to said inner face and comprising a single compressible material disposed in said bottle opening; and a corkscrew guide disposed in said outer face of said closure, said corkscrew guide comprising a shallow annular recess substantially centered on the axis of said cylindrical body and said recess having two non-central perimeter walls, said recess to accept a tip of a corkscrew and said walls providing constraint at any point along the perimeter of said recess, and wherein said recess is adapted to a helix of the corkscrew to promote a central position of the corkscrew during use.

2. In combination with a wine bottle, said bottle having an opening and an extractable closure for said opening, said closure comprising:

a solid cylindrical body having an outer face and an inner face, said cylindrical body comprising a length of said closure from said outer face to said inner face and comprising a single compressible material disposed in said bottle opening; and a corkscrew guide disposed in said outer face of said closure, said corkscrew guide comprising a cylindrical bore substantially centered on the axis of said cylindrical body, said bore to accept and constrain the corkscrew helix, said bore penetrating less than half the length of the closure and said bore penetrating more than one full turn of the corkscrew helix; and wherein said bore is adapted to a helix of the corkscrew to promote guidance along the axis of the closure and a central position of the corkscrew during use.

3. In combination with a wine bottle, said bottle having an opening and an extractable closure for said opening, said closure comprising:

a solid cylindrical body having an outer face and an inner face, said cylindrical body comprising a length of said closure from said outer face to said inner face and comprising a single compressible material disposed in said bottle opening; and a corkscrew guide disposed in said outer face of said closure, said corkscrew guide comprising multiple shallow recesses, said recesses to accept a tip of a corkscrew and each recess having at least one non-central wall to constrain said tip of said corkscrew; and wherein said recesses are adapted to a helix of the corkscrew to promote a central position of the corkscrew during use.

4. The closure of claim 3 wherein said multiple recesses comprise a plurality of co-central annular rings of different diameters assembled according to their diameters.

5. The closure of claim 3 wherein said multiple recesses comprise a plurality of co-central cylindrical recesses of various diameters disposed in said outer face according to diameter, wherein the opening of a smaller recess opens into the bottom of the next larger recess and the largest recess opens on the outer face of the closure.

6. In combination with a wine bottle, said bottle having an opening and an extractable closure for said opening, said closure comprising:

a cylindrical body having an outer face and an inner face, said cylindrical body comprising a length of said closure from said outer face to said inner face and comprising a compressible material and disposed in said bottle opening; and a corkscrew guide disposed in said outer face of said closure, said corkscrew guide comprising a recess to accept a tip of a corkscrew and having at least one wall to constrain said tip of said corkscrew and to promote positioning of the corkscrew as the corkscrew penetrates said closure;

wherein said recess is adapted to a helix of the corkscrew to promote a central position of the corkscrew during use of the corkscrew; and the recess is comprised of multiple intersecting annular recesses not centered on said outer face.

7. In combination with a wine bottle, said bottle having an opening and an extractable closure for said opening, said closure comprising:

a cylindrical body having an outer face and an inner face, said cylindrical body comprising a length of said closure from said outer face to said inner face and comprising a compressible material and disposed in said bottle opening; and a corkscrew guide disposed in said outer face of said closure, said corkscrew guide comprising one or more shallow non-central holes, said holes to accept a tip of a corkscrew, and at least one wall of said hole to constrain said tip of said corkscrew as the corkscrew penetrates said closure; and wherein said one or more holes are adapted to a helix of the corkscrew to promote a central position of the corkscrew during use and extraction of the closure.

8. In combination with a wine bottle, said bottle having an opening and an extractable closure for said opening, said closure comprising:

a cylindrical body having an outer face and an inner face, said cylindrical body comprising a length of said closure from said outer face to said inner face and comprising a single compressible material and disposed in said bottle opening; and a corkscrew guide disposed in said outer face of said closure, said corkscrew guide comprising one or more shallow linear recesses, said recesses to accept a tip of a corkscrew and at least one wall to constrain said tip of said corkscrew as the corkscrew penetrates said closure; and wherein said recesses are adapted to a helix of the corkscrew to promote a central position of the corkscrew during use and extraction of the closure.

9. In combination with a wine bottle, said bottle having an opening and an extractable closure for said opening, said closure comprising:

a cylindrical body having an outer face and an inner face, said cylindrical body comprising a length of said closure from said outer face to said inner face and comprising a single compressible material and disposed in said bottle opening; and a corkscrew guide disposed in said outer face of said closure, said corkscrew guide comprising a shallow cylindrical recess substantially centered on the axis of said cylindrical body, said recess having a non-central perimeter wall to structurally constrain and position the tip of a corkscrew, and wherein the diameter of said recess is adapted to the helix of the corkscrew to promote a central position of the corkscrew during use and extraction of the closure.

* * * * *